US010910691B1

(12) United States Patent
Zekios et al.

(10) Patent No.: US 10,910,691 B1
(45) Date of Patent: Feb. 2, 2021

(54) MULTIPLE INPUT MULTIPLE OUTPUT ANTENNA DEVICES

(71) Applicants: Constantinos L. Zekios, Miami, FL (US); Stavros Georgakopoulos, Miami, FL (US); Nicholas E. Russo, Miami, FL (US)

(72) Inventors: Constantinos L. Zekios, Miami, FL (US); Stavros Georgakopoulos, Miami, FL (US); Nicholas E. Russo, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 0 days.

(21) Appl. No.: 16/677,172

(22) Filed: Nov. 7, 2019

(51) Int. Cl.

| | |
|---|---|
| ***H01Q 1/08*** | (2006.01) |
| ***H01Q 21/06*** | (2006.01) |
| ***H01Q 1/12*** | (2006.01) |
| *H01Q 9/04* | (2006.01) |

(52) U.S. Cl.
CPC ..... *H01Q 1/08* (2013.01); *H01Q 1/1235* (2013.01); *H01Q 21/065* (2013.01); *H01Q 9/0407* (2013.01)

(58) Field of Classification Search
CPC ..... H01Q 1/08; H01Q 1/1235; H01Q 21/065
See application file for complete search history.

(56) References Cited

U.S. PATENT DOCUMENTS

| | | | | |
|---|---|---|---|---|
| 3,525,483 | A * | 8/1970 | Van Alstyne | B64G 1/222 244/172.6 |
| 4,148,163 | A * | 4/1979 | Chenin | B64G 1/222 136/245 |
| 5,319,905 | A * | 6/1994 | Szirtes | B64G 1/443 136/245 |
| 5,351,062 | A * | 9/1994 | Knapp | H01O 1/08 248/436 |
| 5,927,654 | A * | 7/1999 | Foley | B64G 1/222 244/172.6 |
| 7,126,553 | B1 * | 10/2006 | Fink | H01Q 1/08 343/767 |
| 7,864,121 | B2 * | 1/2011 | Suprunov | H01Q 1/08 343/702 |
| 9,706,646 | B2 * | 7/2017 | Jiang | H05K 1/0278 |
| 2006/0187124 | A1 * | 8/2006 | Goldberg | H01Q 1/38 343/700 MS |
| 2009/0009421 | A1 * | 1/2009 | Suprunov | H01Q 1/38 343/881 |
| 2012/0235874 | A1 * | 9/2012 | Kwak | H01Q 1/288 343/837 |

(Continued)

*Primary Examiner* — Ab Salam Alkassim, Jr.
(74) *Attorney, Agent, or Firm* — Saliwanchik, Lloyd & Eisenschenk

(57) ABSTRACT

Multiple-input-multiple-output (MIMO) antenna devices and methods of using and fabricating the same are provided. A MIMO antenna device can include a plurality of substrates each having an antenna element. The substrates can be provided in connected series and can be attached to a framework. The substrates can have alternating style antenna elements, such that a first substrate can have a straight-fed patch and a second substrate adjacent to the first substrate can have a bent-fed patch and a third substrate adjacent to the second substrate, and on an opposite side of the second substrate than the first substrate is, can have a straight-fed patch and so on.

16 Claims, 9 Drawing Sheets

(56) References Cited

U.S. PATENT DOCUMENTS

| | | | | |
|---|---|---|---|---|
| 2016/0231784 | A1* | 8/2016 | Yu | G02F 1/133305 |
| 2018/0301808 | A1* | 10/2018 | Olsen | H01Q 15/08 |
| 2019/0123443 | A1* | 4/2019 | Russell | H01Q 21/0025 |
| 2020/0059011 | A1* | 2/2020 | Sarabandi | H01P 5/222 |

* cited by examiner

MULTIPLE INPUT MULTIPLE OUTPUT ANTENNA DEVICES

GOVERNMENT SUPPORT

This invention was made with government support under Award Number FA9550-18-1-0191 awarded by the Air Force Office of Scientific Research (AFOSR). The government has certain rights in the invention.

BACKGROUND

Multiple-input-multiple-output (MIMO) antenna devices multiply the capacity of a radio link using multiple transmission and receiving antennas to exploit multipath propagation. MIMO has become an essential element of wireless communication standards including IEEE 802.11n (Wi-Fi), IEEE 802.11ac (Wi-Fi), 4G LTE, and 5G, among others. MIMO can also be applied to power-line communication.

A CubeSat is a type of miniaturized satellite for space research that is made up of multiples of small (e.g., 10 cm×10 cm×11.35 cm) cubic units. Due to their relatively low cost, CubeSats have recently grown in popularity, especially for remote sensing and global reconnaissance. For global reconnaissance, a relatively small number of CubeSats are required, allowing the constellation (plurality of CubeSats) to be controlled and reconfigured from the ground. On the other hand, remote sensing requires a swarm of several CubeSats flown in formation. A swarm may include tens to hundreds of CubeSats, and therefore the current methods of commanding CubeSats are no longer applicable.

BRIEF SUMMARY

Embodiments of the subject invention provide novel and advantageous multiple-input-multiple-output (MIMO) antenna devices and methods of using and fabricating the same. A MIMO antenna device can include a plurality of substrates (e.g., planar substrates) each having at least one antenna element. The substrates can be provided in connected series and can be attached to a framework (e.g., a scissor-style framework, such as a scissor-lift actuator). The substrates can have alternating style antenna elements, such that a first substrate can have a straight-fed patch element and a second substrate adjacent to the first substrate can have a bent-fed patch element and a third substrate adjacent to the second substrate (and on an opposite side of the second substrate than the first substrate is) can have a straight-fed patch element and so on. Each substrate can also include circuit elements on which the antenna element (i.e., patch) is disposed.

In an embodiment, a MIMO antenna device can comprise: a substrate; and a plurality of antenna elements (e.g., patch portions) disposed on the substrate and separated from each other by folds in the substrate. The plurality of antenna elements can comprise: at least one straight-fed patch portion, the antenna element for each straight-fed patch portion being a straight-fed antenna element; and at least one bent-fed patch portion, the antenna element for each bent-fed patch portion being a bent-fed antenna element. The at least one straight-fed patch portion and the at least one bent-fed patch portion can be disposed in an alternating fashion such that no straight-fed patch portion is directly adjacent to another straight-fed patch portion and no bent-fed patch portion is directly adjacent to another bent-fed patch portion.

In another embodiment, a MIMO antenna device can comprise: a substrate; and a plurality of antenna elements (e.g., patch portions) disposed on the substrate in a single-file row and separated from each other by folds in the substrate. The plurality of antenna elements can comprise: a plurality of straight-fed patch portions, the antenna element for each straight-fed patch portion being a straight-fed antenna element; and a plurality of bent-fed patch portions, the antenna element for each bent-fed patch portion being a bent-fed antenna element. The plurality of straight-fed patch portions and the plurality of bent-fed patch portions can be disposed in an alternating fashion such that no straight-fed patch portion is directly adjacent to another straight-fed patch portion and no bent-fed patch portion is directly adjacent to another bent-fed patch portion.

In alternative embodiments, the antenna elements can be respectively disposed on separate substrates that are connected by hinges; that is, instead of one substrate with folds separating the antenna elements, the antenna device can include separate substrates separated and connected by hinges that allow folding of the substrates relative to each other.

DETAILED DESCRIPTION

Embodiments of the subject invention provide novel and advantageous multiple-input-multiple-output (MIMO) antenna devices and methods of using and fabricating the same. A MIMO antenna device can include a plurality of substrates (e.g., planar substrates) each having an antenna element. The substrates can be provided in connected series and can be attached to a framework (e.g., a scissor-style framework, such as a scissor-lift actuator). The substrates can have alternating style antenna elements, such that a first substrate can have a straight-fed patch and a second substrate adjacent to the first substrate can have a bent-fed patch and a third substrate adjacent to the second substrate (and on an opposite side of the second substrate than the first substrate is) can have a straight-fed patch and so on, though embodiments are not limited thereto (e.g., the substrates can have the same and/or different types of antenna elements disposed thereon or on adjacent substrates). Each substrate can also include circuit elements on which the antenna element (i.e., patch) is disposed.

MIMO antennas of embodiments of the subject invention can adjust in real time both their capacity and gain (e.g., based on the channel requirements). The channel capacity and the gain can be varied as a function of inter-element spacing (i.e., spacing between adjacent antenna elements (antenna elements on adjacent substrates)). For example, there can be a variation of up to 50% or more for both capacity and gain. An origami-inspired mechanism can be used to accommodate the physical reconfiguration of the MIMO antenna device and also provide high packing efficiency. The substrates can be attached to each other such that they are essentially fabricated from one monolithic substrate that is folded at one or more positions to create the adjacent substrates (e.g., one fold would create two adjacent substrates, two folds would create three adjacent substrates, and so on). This mechanism can provide for easy control of inter-element spacing so that the channel capacity and gain can be varied as desired.

In many embodiments, the substrates can be attached to a framework to hold them in a desired configuration. The framework can be, for example, an accordion structure, which can allow for easy variation of inter-element spacing. The accordion structure can be, for example, a scissor-lift actuator or scissor-lift structure/mechanism. The framework can be 3D printed, though embodiments are not limited thereto. Fabricating the framework by 3D printing can allow for generation of the framework to the exact specifications desired for a specific MIMO device.

Figure 1:
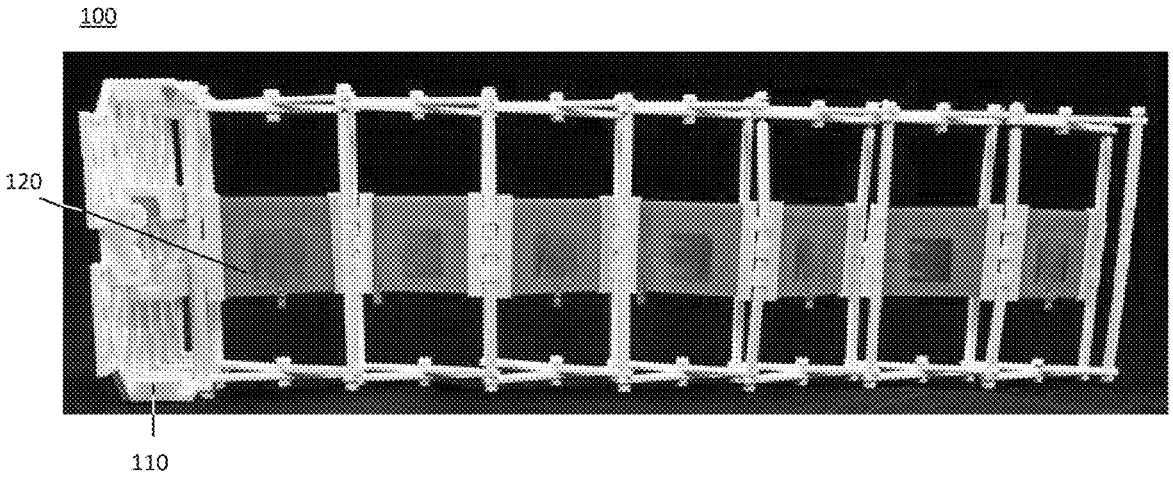
FIG. 1 is an image showing a multiple-input-multiple-output (MIMO) antenna device according to an embodiment of the subject invention.
Figure 9A:
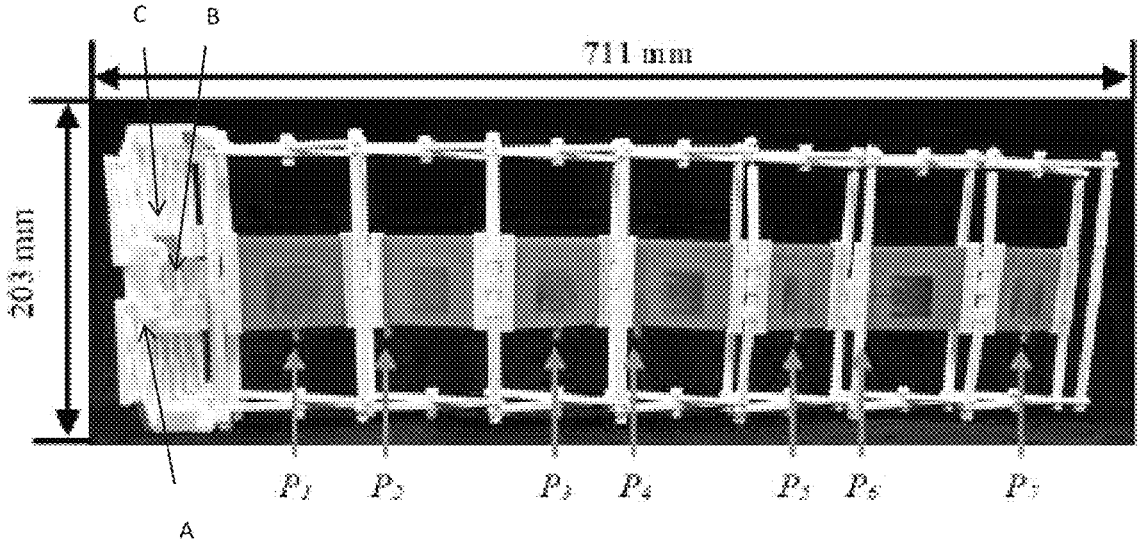
FIG. 9A is an image showing a MIMO antenna device according to an embodiment of the subject invention.
Figure 9B:
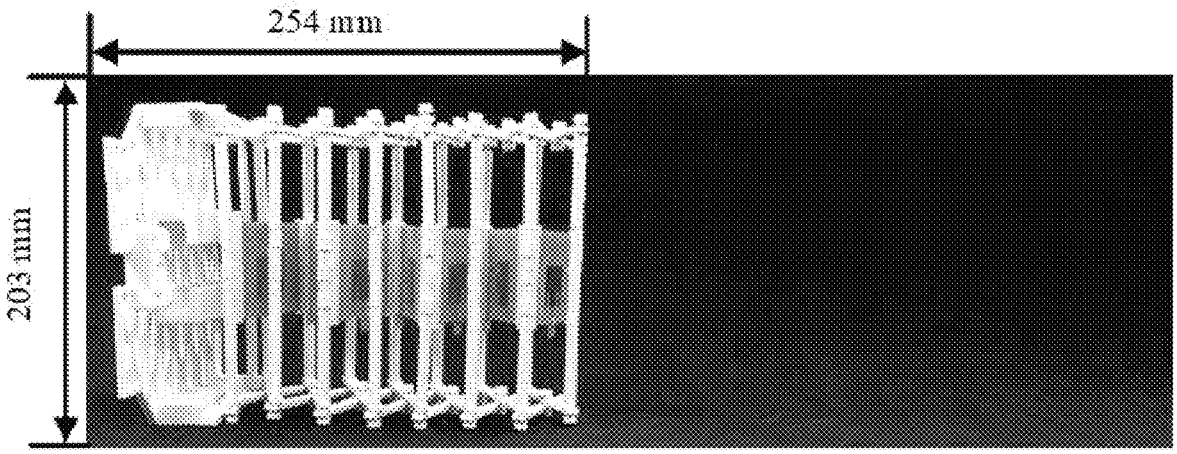
FIG. 9B is an image showing a MIMO antenna device according to an embodiment of the subject invention.

FIG. 1 shows a MIMO antenna device according to an embodiment of the subject invention. Referring to FIG. 1, the MIMO antenna device 100 can include a plurality of patch portions 120 (e.g., planar patch sections or planar patches) disposed on a framework 110. Each portion 120 can include a patch (i.e., antenna element) disposed on a substrate (e.g., a planar substrate). It is noted that the term "patch" and the term "antenna element" are used interchangeably herein. The framework 110 shown in FIG. 1 is a scissor-lift actuator, which allows the antenna elements to be identically and simultaneously folded using at least one motor (e.g., a single motor) of the scissor-lift actuator. This means that the inter-element spacing can be quickly and easily varied at any time using the motor by causing the patch portions 120 to be folded such that the respective portions of the patch portions 120 having the respective antenna elements are brought closer to each other, thereby decreasing the inter-element spacing, or made to be farther apart from each other, thereby increasing the inter-element spacing. The patch portion 120 can include at least two layers, which can be held together via, for example, glue, sewing and/or stitching, adhesive, epoxy, or any other suitable connecting means. FIGS. 9A and 9B also show images of a MIMO antenna device with a scissor-lift actuator framework in opened and compressed states, respectively. The dimensions listed on FIGS. 9A and 9B are for exemplary purposes only and should not be construed as limiting. Reference characters A, B, and C in FIG. 9A show a motor mount, a drive nut, and guide rails, respectively, of the scissor-lift actuator framework; these elements can be used to vary the inter-element spacing.

Figure 2:
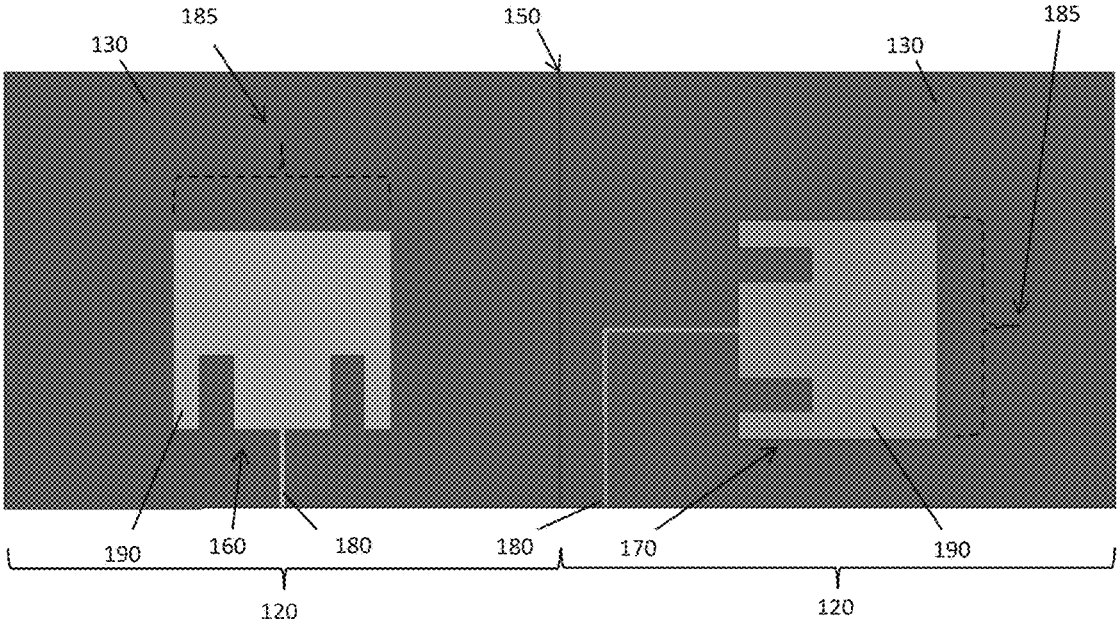
FIG. 2 is a schematic view showing a portion of a MIMO antenna device according to an embodiment of the subject invention, with a straight-fed patch adjacent to a bent-fed patch.

FIG. 2 shows a portion of a MIMO antenna device, with two adjacent patch portions 120, according to an embodiment of the subject invention. Referring to FIG. 2, each patch portion 120 can include an antenna element 180/ disposed on a substrate 130. Each patch portion 120 can further include circuit elements 190 on which the antenna element is disposed. Each patch portion can include a straight-fed patch 160 or a bent-fed patch 170. The straight-fed patch 160 can have an antenna element 180 trace that extends in a straight line from an edge of the substrate 130 and then is connected with an E-shaped patch, where the E-shaped patch has a distal flat side 185 (i.e., the flat side that is opposite from the proximal side where the antenna element trace connects with the patch) that faces a side of the patch portion 120 that is opposite from the side from which the antenna element trace originally extended. The bent-fed patch 170 can have an antenna element 180 trace that extends in a straight line from an edge of the substrate 130, has a first turn (e.g., such that the antenna element trace after the first turn is perpendicular, or approximately perpendicular, to the antenna element trace before the first turn), and then is connected with an E-shaped patch, where the E-shaped patch has a distal flat side 185 (i.e., the flat side that is opposite from the proximal side where the antenna element trace connects with the patch) that faces a side of the patch portion 120 that is opposite from the side from which the antenna element trace originally extended.

Figure 10:
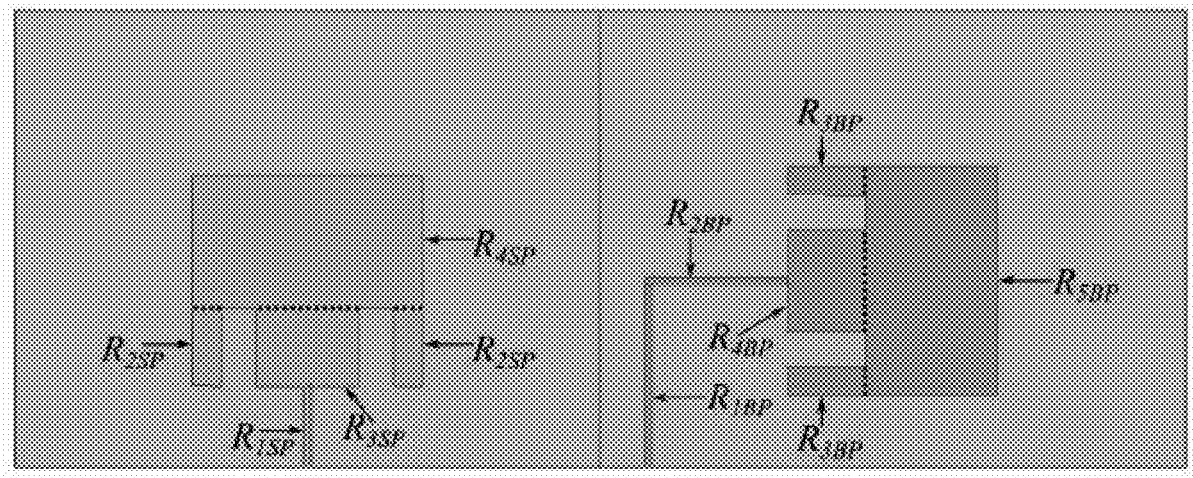
FIG. 10 is a schematic view showing a portion of a MIMO antenna device according to an embodiment of the subject invention, with a straight-fed patch adjacent to a bent-fed patch.

In the straight-fed patch 160, the distal flat side 185 can face towards an edge of the substrate 130 that is opposite from that from which the antenna element 180 originally extended such that the edge of the substrate 130 the distal flat side 185 faces is parallel to the edge from which the antenna element 180 originally extended. In the bent-fed patch 170, the distal flat side 185 can face towards an edge of the substrate 130 that is adjacent to that from that from which the antenna element 180 originally extended such that the edge of the substrate 130 the distal flat side 185 faces is perpendicular to the edge from which the antenna element 180 originally extended. The circuit elements 190 can also be bent differently in the bent-fed patch 170 compared to the straight-fed patch 160, though embodiments are not limited thereto. Two adjacent patch portions 120 can be differentiated by a fold 150 (or a hinge 155, see FIG. 3) between them. In many embodiments, a straight-fed patch 160 portion is directly adjacent to a bent-fed patch 170 portion, with just a fold 150 (or hinge 155, see FIG. 3) between them. FIG. 10 also shows a portion of a MIMO antenna device, with two adjacent patch portions, according to an embodiment of the subject invention, with a straight-fed patch on the left and a bent-fed patch on the right.

Figure 3:
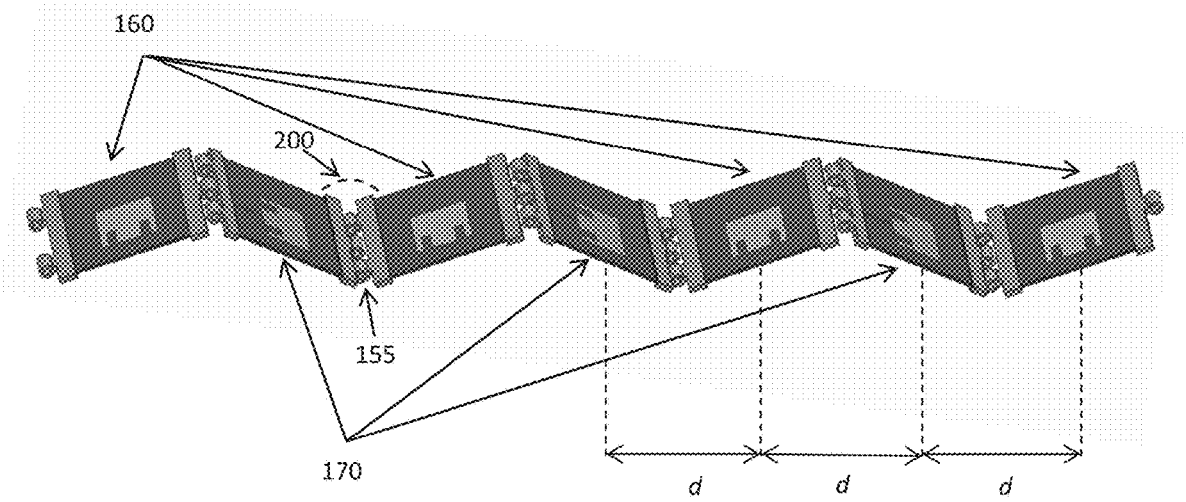
FIG. 3 is a schematic view showing a MIMO antenna device according to an embodiment of the subject invention.

FIG. 3 shows a plurality of patch portions 120 of a MIMO antenna device according to an embodiment of the subject invention. Referring to FIG. 3, the inter-element spacing d between adjacent patch portions 120 can be seen. The inter-element spacing d is measured from the center of the patch 160,170 of a patch portion 120 to the center of the patch 160,170 of an adjacent patch portion (e.g., a shortest distance between adjacent patch centers). The patch centers of the antenna elements 180 of the patch portions 120 can be aligned, or mostly aligned, with each other such that they all fall along an imaginary line that is parallel (or approximately parallel) to an edge of the substrate 130 (e.g., the edge of the substrate from which the antenna element extends). The antenna device can include patch portions 120 that alternate with straight-fed patches 160 and bent-fed patches 170. This configuration of adjacent/neighboring patch portions 120 being placed with orthogonal antenna elements minimizes mutual coupling within the antenna device. Hinges 155 (or folds 150, see FIG. 2) can be included between adjacent/neighboring patch portions 120, and this allows for the patch portions 120 to be disposed on a framework that can actuate to easily increase or decrease inter-element spacing d (e.g., using an accordion-style framework) by increasing or decreasing, respectively, the angle 200 between adjacent patch portions 120. It is noted that the term fold angle $\psi$ is used herein and is equal to one half of the result of 180° minus the angle 200 depicted in FIG. 3; that is, $\psi$=(180°−angle 200)/2 (see also, e.g., the inset of each of FIGS. 4-6 and 8 showing $\psi$). The style of antenna device shown in FIG. 3, with hinges, is also depicted in FIGS. 9A and 9B.

The material for each substrate 130 can be any suitable material known in the art. For example, each substrate can be paper, cardboard, plastic, or a relatively rigid material such as FR4 (a composite material comprising woven fiberglass cloth with an epoxy resin binder that is flame resistant). In an embodiment, the substrates 130 can all be the same material, and in alternative embodiment, multiple different materials can be used for respective substrates 130. In many embodiments, the substrates 130 of the patch portions 120 are all part of the same single substrate or substrate piece and are just separated into individual sections by the folds 150 or hinges 155.

The material for each antenna element 180 can be any suitable material known in the art. For example, each antenna element can be copper, aluminum, gold, silver, or platinum. In an embodiment, the antenna elements 180 can all be the same material, and in alternative embodiment, multiple different materials can be used for respective antenna elements 180.

The antenna elements 180 can be designed to resonate at a desired frequency, either all at the same frequency or at multiple respective frequencies. For example, all antenna elements 180 can be designed to resonate at a frequency band of about 2.4-2.5 gigahertz (GHz). Each substrate 130 can have a thickness of any of the following values, at least any of the following values, about any of the following values, no more than any of the following values, or within any range having any of the following values as endpoints (all values are in millimeter (mm)): 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2, 2.5, 3, 3.5, 4, 4.5, 5, 5.5, 6, 6.5, 7, 7.5, 8, 8.5, 9, 9.5, 10, 11, 12, 13, 14, or 15. All substrates 130 can have the same thickness, though embodiments are not limited thereto. Each substrate 130 can have a relative electric permittivity ($\varepsilon_r$) of any of the following values, at least any of the following values, about any of the following values, no more than any of the following values, or within any range having any of the following values as endpoints (all values are unit-less)): 1, 1.5, 2, 2.5, 3, 3.5, 4, 4.1, 4.2, 4.3, 4.4, 4.5, 4.6, 4.7, 4.8, 4.9, 5, 6, 7, 8, 9, 10, 15, or 20. All substrates 130 can have the same permittivity, though embodiments are not limited thereto.

In an embodiment, a method fabricating a MIMO antenna device can comprise providing a substrate material and forming antenna elements 180 (and circuit elements 190, if present) thereon. The elements can be formed on the substrate using techniques such as deposition (and lithography as appropriate). For example, all straight-fed patches 160 can be formed together and all bent-fed patches 170 can be formed separate from the straight-fed patches 160; or all straight-fed patches 160 and all bent-fed patches 170 can be formed together; or a combination can be used such that some straight-fed patches 160 are formed together with bent-fed patches 170. After forming the antenna elements 180 (and circuit elements 190, if present), the substrate material can be cut into strips of single-file patch portions 120 (as depicted in FIG. 3); this is not necessary if only one row of patch portions 120 is present. Then the row(s) of patch portions 120 can be folded such that a fold 150 is present between each patch portion 120 and any adjacent patch portion 120 thereto, as depicted in FIG. 2; or the row(s) of patch portions 120 can be separated into the portions 120 and connected by hinges 155, as depicted in FIG. 3. The row of patch portions 120 can then be disposed on a framework 110, such as an actuating framework. The patch portions 120 can be attached to the framework via, for example, glue, sewing and/or stitching, adhesive, epoxy, or any other suitable connecting means.

Though the figures depict the case where straight-fed patches and bent-fed patches are alternated, embodiments of the subject invention are not limited thereto. Any configuration can be used, including straight-fed patches adjacent to each other, bent-fed patches adjacent to each other, all straight-fed patches, all bent-fed patches, etc. In addition, though the figures depict the case where a single-file row of patch portions is used, the patch portions can be provided in an array or other configuration. Also, though patches have been discussed herein, each "patch portion" (or all "patch portions") can instead have a dipole-style or other style antenna element.

MIMO antenna devices of embodiments of the subject invention can adjust in real time both their capacity and gain (e.g., based on the channel requirements). The channel capacity and the gain can be varied as a function of inter-element spacing d. For example, there can be a variation of 50% for both capacity and gain; these values depend on the type of antenna elements used (e.g., dipoles, patches) and the type of spatial configuration. This ability can be used for network (e.g., 5G), internet-of-things (IoT), and similar applications where the speed of transmitted information and bit error rate (BER) reduction are important.

Embodiments of the subject invention provide stowable, reconfigurable, origami enabled MIMO antennas that can adapt to changes in the communication environment through inter-element spacing variation. By mounting the antenna on framework (e.g., a scissor lift mechanism), only a single actuator is required to precisely and accurately adjust the inter-element spacing over many cycles. Mounting on a framework offers an easily stowable MIMO antenna that can achieve a reduction in length (e.g., a reduction of at least 36%). When directional patch elements are used, a large increase in channel capacity can be observed through inter-element spacing reconfiguration (e.g., an increase of at least 3.3 bits/s/Hz).

In a MIMO system composed of $n_t$ transmit and $n_r$ receive antennas, the information theoretical channel capacity is given by Equation (1) below, where C represents the channel capacity in bits/s/Hz, which is averaged over $N_r$ realizations of the channel matrix $H^u$ to produce the mean channel capacity $C_m$. This averaging is done to characterize system behavior over various scattering environments. Different scattering environments are modeled by having the elements of $H^u$, denoted as $H^u_{ij}$ be an uncorrelated complex Gaussian process with zero mean and unit variance. ρ is the received signal-to-noise ratio (SNR) when elements are completely isolated from one another and is given by $\rho=P_o/(L_0P_n)$ where $P_o$ is the average input power to the transmit array, $L_0$ is the mean path loss, and $P_n$ is the mean noise power per element.

$$C = \log_2\left(\det\left[I_M + \frac{\rho}{n_r} HH^\dagger\right]\right) \tag{1}$$

The effect of the antenna parameters on the channel matrix is observed through Equation (2) below, where $Z_T=Z^T(Z^T+Z_S)^{-1}$ and $Z_R=Z_L(Z^R+Z_L)^{-1}$, where $Z^T$ and $Z^R$ represent the antenna impedance matrices at the transmitter and receiver sides, respectively, and $Z_S$ and $Z_L$ are composed of the $n_t$ source impedances and $n_r$ load impedances, respectively. Moreover, $C_T$ and $C_R$ are also functions of the impedance matrices as $C_T=Z^T_{11}/(Z^T_{11}+Z^T_{11}*)$ and $C_R=Z^R_{11}*/(Z^R_{11}+Z^R_{11}*)$. Spatial correlation between elements of the same array is accounted for by $\Psi_T$ and $\Psi_R$. The elements of $\Psi_T$ and $\Psi_R$ are given as $\Psi_{ij}=J_0(k_0d_{ij})$, where $d_{ij}=|i-j|d$, where d is the inter-element spacing. This spatial correlation is given by Jakes' model, which characterizes a rich scattering environment by assuming a uniform distribution of angles of arrival for plane waves at the receive antenna. It is noted that † represents the Hermitian conjugate.

$$HH^\dagger = \frac{Z_R\Psi^R Z_R^\dagger H^u Z_T^\dagger \Psi^T Z_T H^{u\dagger}}{|C_T C_R|^2} \tag{2}$$

Ideal assumptions can be made to isolate the effect of antenna parameters on the mean capacity. Conjugate matching can be assumed for maximum power transfer between the source impedances and the transmit antenna elements, meaning $Z_{sn}=Z^T*$. Similarly, to maximize power transfer between the receive antenna elements and the load impedances, $Z_{lm}=Z^R*_{mm}$, where * denotes complex conjugation. Further, it can be assumed that all the elements are perfectly matched, such that $Z^T=Z^R=50\Omega$, and all elements on both the transmitter and receiver are completely isolated from one another. It is important to note that spatial correlation between elements may be nonzero although the elements are perfectly isolated. To characterize system performance over a sufficient number of scattering environments, $N_r$ can be set to 1000. Therefore a set of random channel matrices $\{H^{(i)}\}_{I=1\ to\ 1000}$ can be created and normalized such that the condition $E[\|H^{(i)}\|^2_F]=n_rn_t$ is satisfied.

Figure 7:
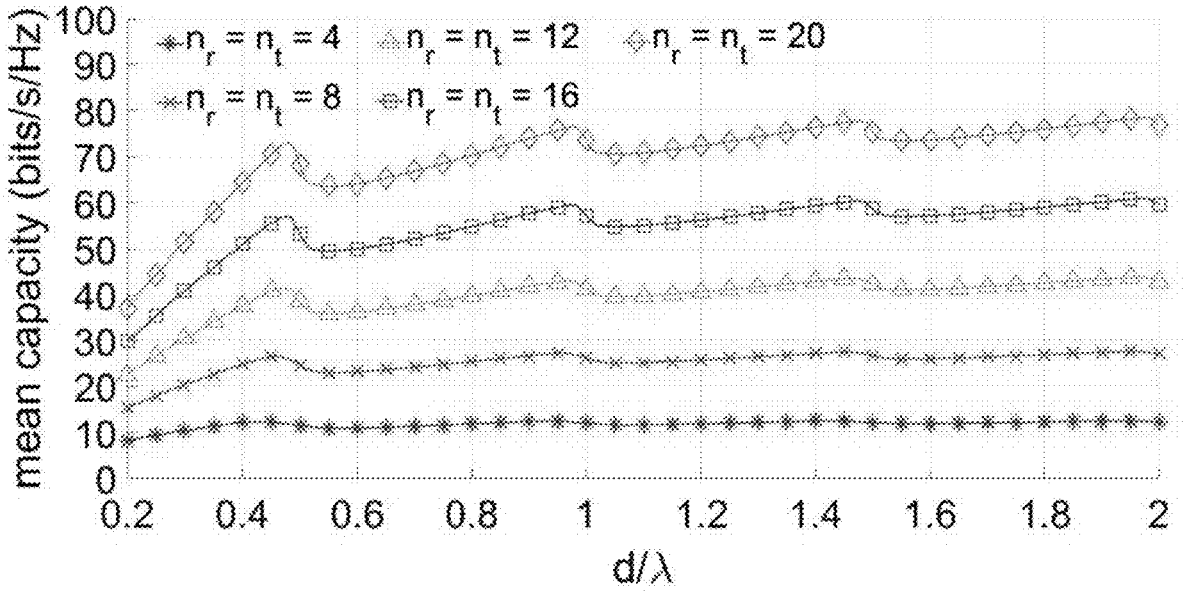
FIG. 7 is a plot of mean capacity (in bits/s/Hz) versus inter-element spacing (d, in FIG. 3) divided by wavelength for various MIMO systems when received signal-to-noise ratio (SNR; $\rho$)=10 dB. The bottommost line is for $n_r$ (number of receiving elements)=$n_t$ (number of transmitting elements)=4; the second-bottommost line is for $n_r$=$n_t$=8; the middle line is for $n_r$=$n_t$=12; the second-uppermost line is for $n_r$=$n_t$=16; and the uppermost line is for $n_r$=$n_t$=20.

When designing a MIMO communications link to achieve a throughput requirement, determination of the number of transmit and receive antennas, $n_t$ and $n_r$, as well as their maximum dimension, is of primary importance. If uniform MIMO antennas are used, the largest dimension is the length, denoted as $L_t$ for the transmit antenna and $L_r$ for the receive antenna. For a MIMO system operating in a rich scattering environment the channel capacity is constrained by $\min(n_r,n_t)$. Thus, for simplicity $n_r=n_t$ can be set. For further simplicity, it can be assumed that both the transmit and receive antennas are identical, meaning $L_t=L_r=L$. Therefore, characterizing the effect of the normalized inter-element spacing d/λ on the mean capacity $C_m$ allows the interaction between these parameters to be readily understood assuming a fixed frequency of operation. This relationship is shown in FIG. 7 for various MIMO systems. It is important to note that because Equation (2) is only a function of impedance matching, FIG. 7 is independent of the radiating elements used.

A fixed frequency of operation and a fixed number of radiating elements leaves the mean channel capacity a function of MIMO antenna length, L. Therefore, a mean capacity reconfigurable antenna can be achieved by varying the inter-element spacing d, thereby changing the total length of the antenna L. It is important to note that the trends shown in FIG. 7 are independent of ρ.

FIG. 7 demonstrates that regardless of the number of transmit or receive antennas, mean channel capacity is a monotonically increasing function of inter-element spacing for $d/\lambda\leq0.48$. Beyond that point, monotonicity is lost and the mean capacity achieves a local peak approximately every 0.48λ with the mean capacity at each successive local peak slightly increasing. For $n_r=n_t>20$, similar behavior is observed with the channel capacity monotonically increasing for $d/\lambda\leq0.5$ with local peaks every 0.5λ. This behavior is mainly attributed to the spatial correlation between the elements given by $\Psi^R$, $\Psi^T$ and can be observed in both measurements and simulations. Therefore, under these assumptions, increasing the inter-element spacing beyond 0.5λ provides little benefit in terms of mean capacity. It is important to note that under a different set of assumptions, this is not the case.

The reconfigurability and stowability of antennas of embodiments of the subject invention make them ideal for applications in extra-terrestrial dynamic propagation environments such as in reconfigurable remote sensing CubeSat swarms. Reconfigurable swarms allow various measurements to be performed using the same CubeSats rather than requiring new satellites to be launched. For instance, a project may require both simultaneous global data logging as well as data logging in a confined space. In this case, the CubeSat swarm will reconfigure from a string-of-pearls formation for global data logging to an ellipsoid formation for confined data logging. A high throughput communication link must be maintained among the satellites of the swarm as ground personnel are unable to control the large number of CubeSats individually. The mean channel capacity of MIMO antennas of embodiments of the subject invention in a reconfigurable remote sensing CubeSat swarm was characterized in Example 3 below.

A greater understanding of the embodiments of the subject invention and of their many advantages may be had from the following examples, given by way of illustration. The following examples are illustrative of some of the methods, applications, embodiments, and variants of the present invention. They are, of course, not to be considered as limiting the invention. Numerous changes and modifications can be made with respect to the invention.

Example 1

A MIMO antenna row comprising seven patch portions (similar to that shown in FIG. 3) was fabricated on an FR4 substrate. Straight-fed patch portions and bent-fed patch portions were alternated. The substrate had a relative electric permittivity of 4.4 and a thickness 1.5 mm. All the antenna elements were designed to resonate at a frequency band of 2.43-2.49 GHz. The accordion structure was selected because it allows for the inter-element spacing to be varied with minimal mutual coupling. The patch portions were attached to a 3D-printed scissor lift actuator having a single motor, and the result is shown in FIG. 1.

Figure 4:
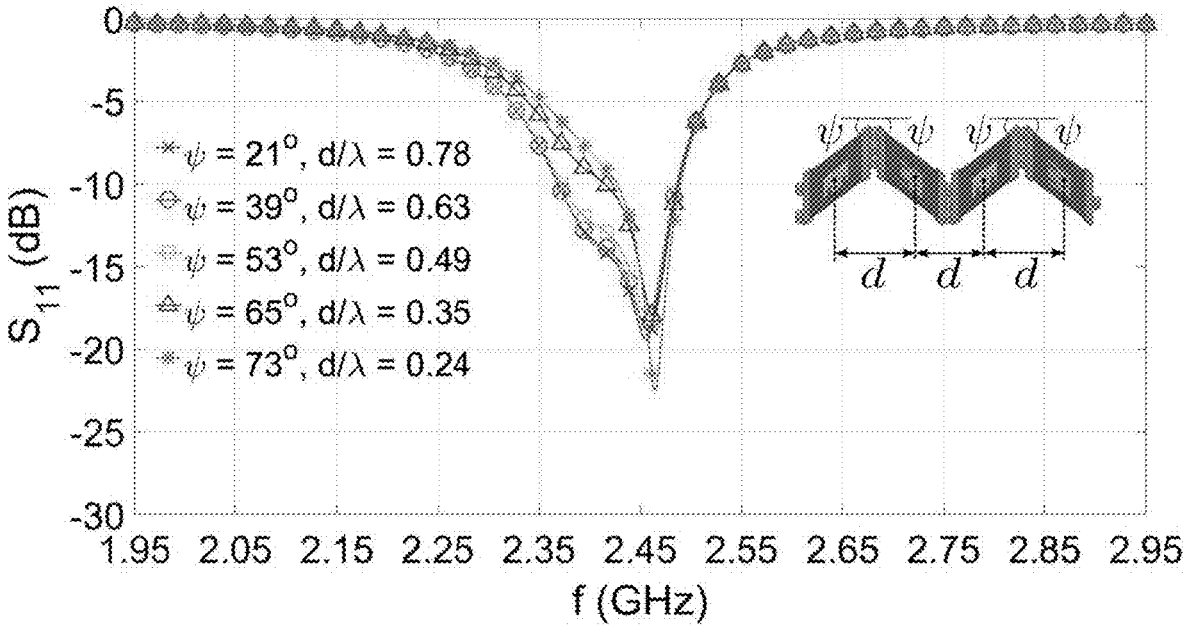
FIG. 4 is a plot of reflection coefficient (in decibel (dB)) versus frequency (in gigahertz (GHz)) for straight-fed patch antenna elements.
Figure 5:
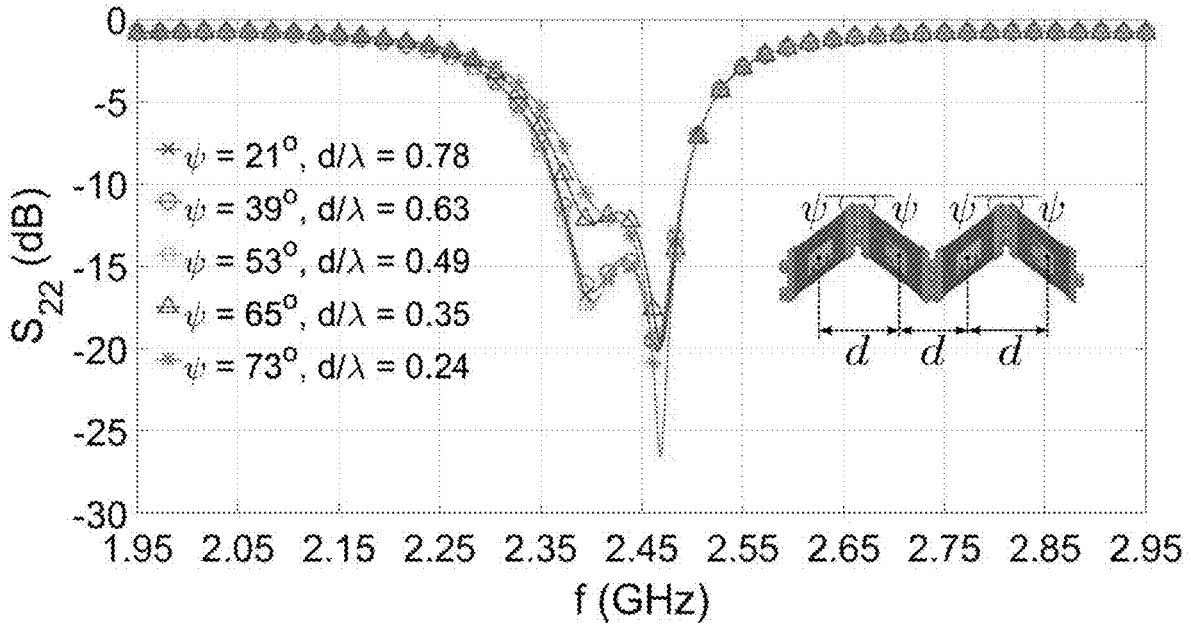
FIG. 5 is a plot of reflection coefficient (in dB) versus frequency (in GHz) for bent-fed patch antenna elements.
Figure 6:
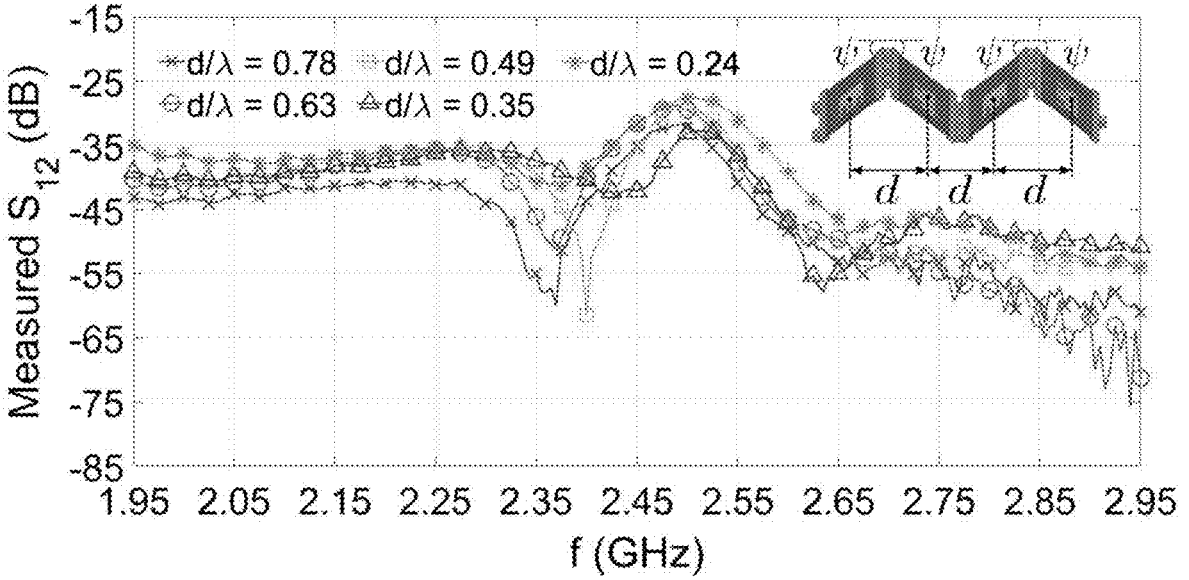
FIG. 6 is a plot of mutual coupling (in dB) versus frequency (in GHz) between adjacent elements (a straight-fed patch antenna element and an adjacent bent-fed patch antenna element).

The scissor lift actuator of the MIMO antenna was adjusted to different folding angles (u) and inter-element spacing d while various properties of the antenna were measured. The results are shown in FIGS. 4-6 and 8. It is noted that λ shown in the inset of FIGS. 4-6 is the wavelength of transmission (e.g., for 2.4 GHz transmission, λ is about 125 mm).

Figure 8:
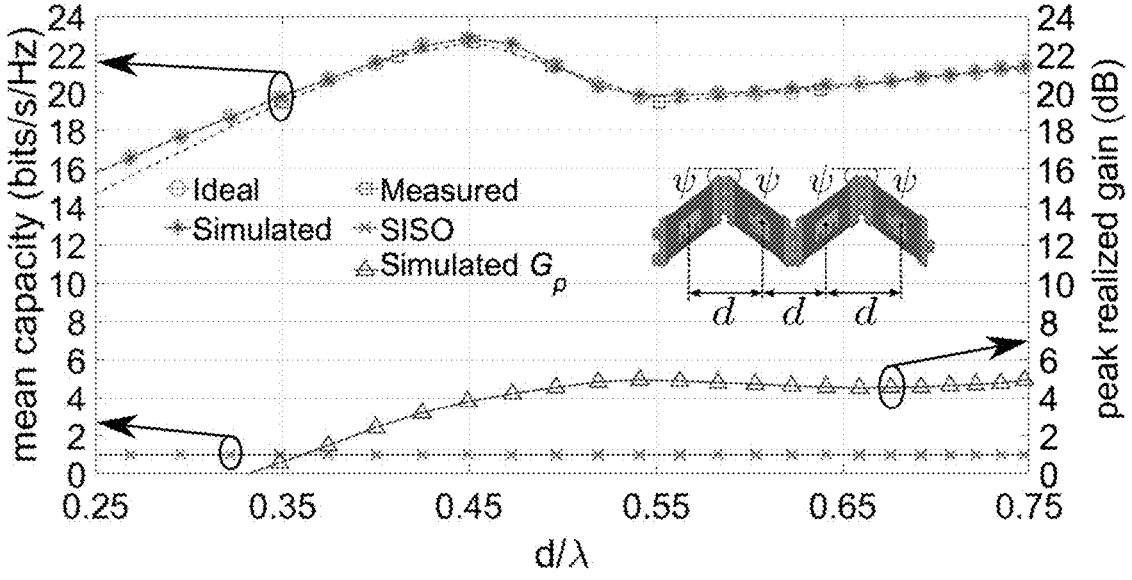
FIG. 8 is a plot of mean capacity (in bits/s/Hz; left vertical axis) and peak realized gain (in dB; right vertical axis) versus the result of inter-element spacing (d, in FIG. 3) divided by wavelength (horizontal axis) and versus fold angle ($\psi$, in degrees; bottom horizontal axis). The uppermost three lines are for a MIMO system according to an embodiment of the subject invention (the dashed line corresponds to the ideal capacity without mutual coupling, the solid line with circular markers corresponds to the simulated capacity and the dashed line with square markers corresponds to the measured capacity); the middle line is for the peak realized gain of the MIMO system; and the bottommost line is the mean capacity of a single-input-single-output (SISO) system. It is noted that fold angle $\psi$ is equal to one half of the result of 180° minus the angle 200 depicted in FIG. 3; that is, ψ=(180°−angle 200)/2, and this can be seen based on the inset of each of FIGS. 4-6 and 8 showing ψ.

FIG. 4 is a plot of reflection coefficient (in decibel (dB)) versus frequency (in gigahertz (GHz)) for the straight-fed patch antenna elements of the fabricated MIMO antenna. FIG. 5 is a plot of reflection coefficient (in dB) versus frequency (in GHz) for the bent-fed patch antenna elements of the fabricated MIMO antenna. FIG. 6 is a plot of mutual coupling (in dB) versus frequency (in GHz) between adjacent elements (a straight-fed patch antenna element and an adjacent bent-fed patch antenna element) in the fabricated MIMO antenna. FIG. 8 is a plot of mean capacity (in bits/s/Hz; left vertical axis) and peak realized gain (in dB; right vertical axis) versus the result of inter-element spacing d divided by wavelength λ. It is noted that fold angle Ψ is equal to one half of the result of 180° minus the angle 200 depicted in FIG. 3; that is, Ψ=(180°−angle 200)/2.

Referring to FIGS. 4-6 and 8, it can be seen that the channel capacity and the gain can advantageously be varied as a function of inter-element spacing d up to 53% and 50%, respectively.

Example 2

A MIMO antenna row comprising seven patch portions (similar to that shown in FIGS. 1, 3, 9A, and 9B) was fabricated on an FR4 substrate. Adjacent patch portions were as shown in FIGS. 2 and 10. The elements were designed at 2.45 GHz due to its popularity as a mobile band. Comparison between this antenna and an antenna using patch style elements demonstrates the effect the element radiation pattern has on channel capacity.

Each E-shaped patch antenna comprises a standard patch antenna, two slots, and a microstrip feed (also referred to as antenna element trace earlier herein), as seen in FIGS. 2 and 10. The slots increase the bandwidth of the otherwise narrowband standard patch by introducing a second, lower frequency resonance near the original resonance of the patch. The length of the slot determines the lower frequency resonance and the width and position of the slot are used to improve the quality of the matching. The microstrip feed acts as a quarter wave transformer.

Dual-polarized MIMO systems offer large capacity gains under certain channel conditions when compared with single polarized systems. To achieve dual-polarization, the elements of the MIMO antenna were co-aligned and orthogonally positioned with respect to one another. To feed the rotated elements, bent-fed versions of the microstrip patch were created. The dimensions of the straight and bent-fed patches are provided in Table I below (see also FIG. 10 for location of "patch components").

The elements of the MIMO antenna were fabricated on 1.5 mm thick FR4 epoxy with a relative permittivity of 4.4 using an LPKF S103 milling machine. The elements were mounted on a 3D printed, modified scissor lift actuation mechanism as shown in FIGS. 9A and 9B. The structure was printed using polylactic acid (PLA) with a relative permittivity of 2.88 at 2.45 GHz using the Makerbot Z18. The seven ports of the MIMO antenna are denoted by $P_1$ through $P_7$, respectively, in FIG. 9A.

TABLE I

STRAIGHT AND BENT-FED PATCH DIMENSIONS

| Patch Component | x̂ Dimension (mm) | ŷ Dimension (mm) |
|---|---|---|
| $R_{1SP}$ | 1 | 12 |
| $R_{2SP}$ | 4.25 | 11.25 |
| $R_{3SP}$ | 15 | 11.25 |
| $R_{4SP}$ | 33.5 | 19.25 |
| $R_{1BP}$ | 1 | 27.5 |
| $R_{2BP}$ | 20.75 | 1 |
| $R_{3BP}$ | 11.25 | 4.25 |
| $R_{4BP}$ | 11.25 | 15 |
| $R_{5BP}$ | 19.25 | 33.5 |

The scissor lift mechanism allows uniform inter-element distance variation using a single actuator. Therefore, the mechanical construction of this antenna makes actuation repeatable, precise, and accurate. The 3D printed antenna made of PLA, as shown in FIGS. 9A and 9B, is only a non-limiting example. If a more durable material is used, accurate and precise actuation over a large number of cycles is possible. The uniform inter-element spacing provided by the scissor lift mechanism was varied using a screw actuator comprising a motor mount, drive nut, and guide rails as denoted by reference characters A, B, and C, respectively, in FIG. 9A. The actuating motor and screw are not shown.

The MIMO antenna had a volume of 711 mm×190 mm×203 mm and 254 mm×190 mm×203 mm in the fully unfolded and folded states, respectively. Thus, the length of the antenna could be reduced by 36% through folding. The height of the scissor lift was made sufficiently large to allow easy access to the antennas for feeding, but this is not necessary.

Figure 11:
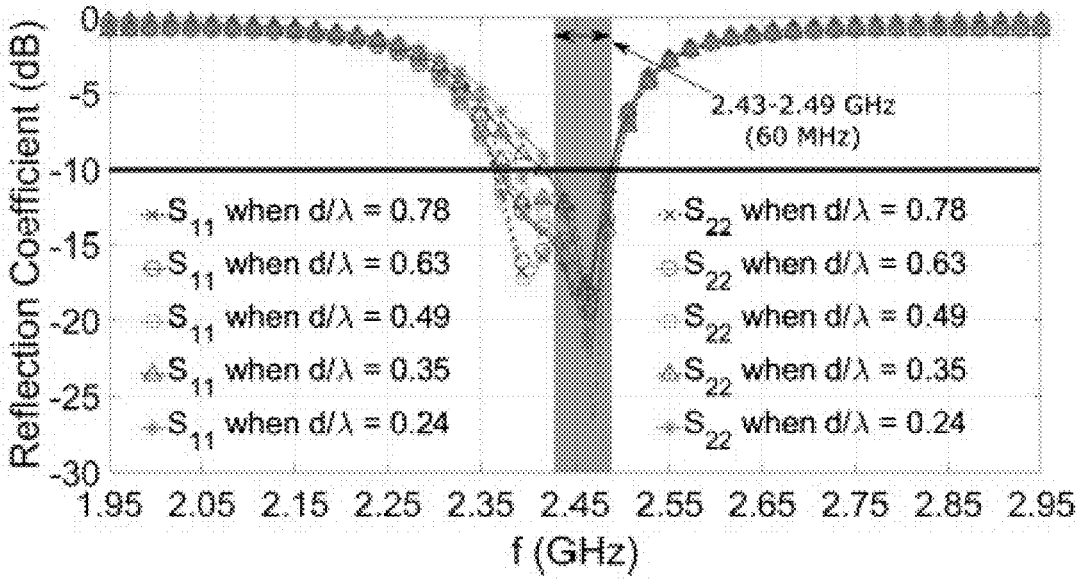
FIG. 11 is a plot of reflection coefficient (in dB) versus frequency (in GHz) for a MIMO antenna device for various inter-element spacings.

FIG. 11 shows the reflection coefficient for antenna. Table II shows the 10 dB bandwidth shared by both straight- and bent-fed elements for various inter-element spacings. FIG. 11 demonstrates that matching is impacted by inter-element spacing. However, regardless of the inter-element spacing, the straight- and bent-fed patches shared the 2.43-2.49 GHz band.

Figure 12A:
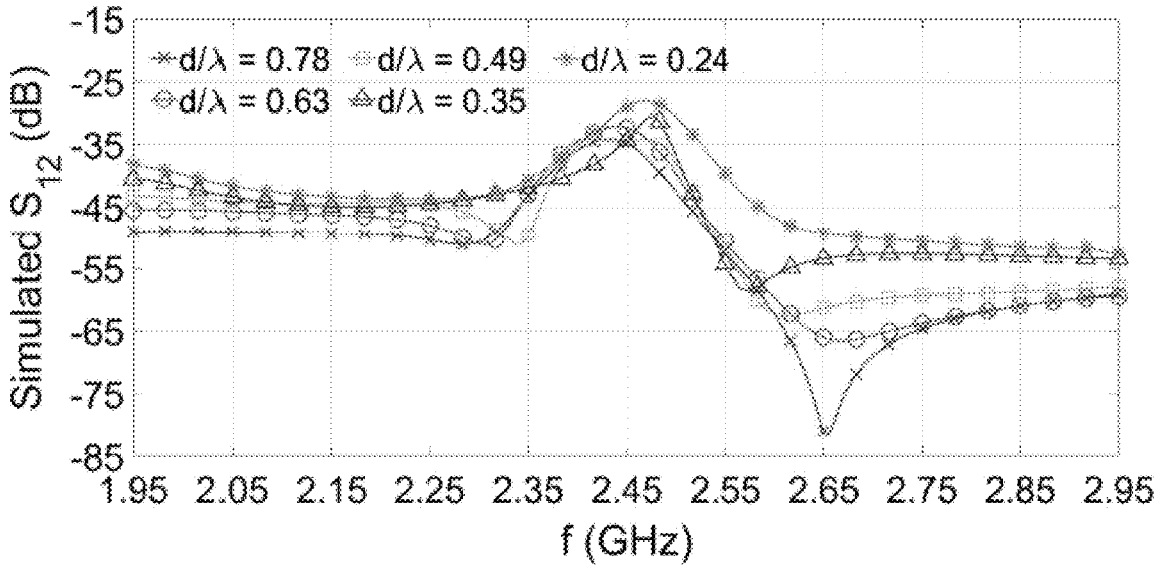
FIG. 12A is a plot of simulated mutual coupling (in dB) between closest straight-fed and bend-fed patches for various inter-element spacings.
Figure 12B:
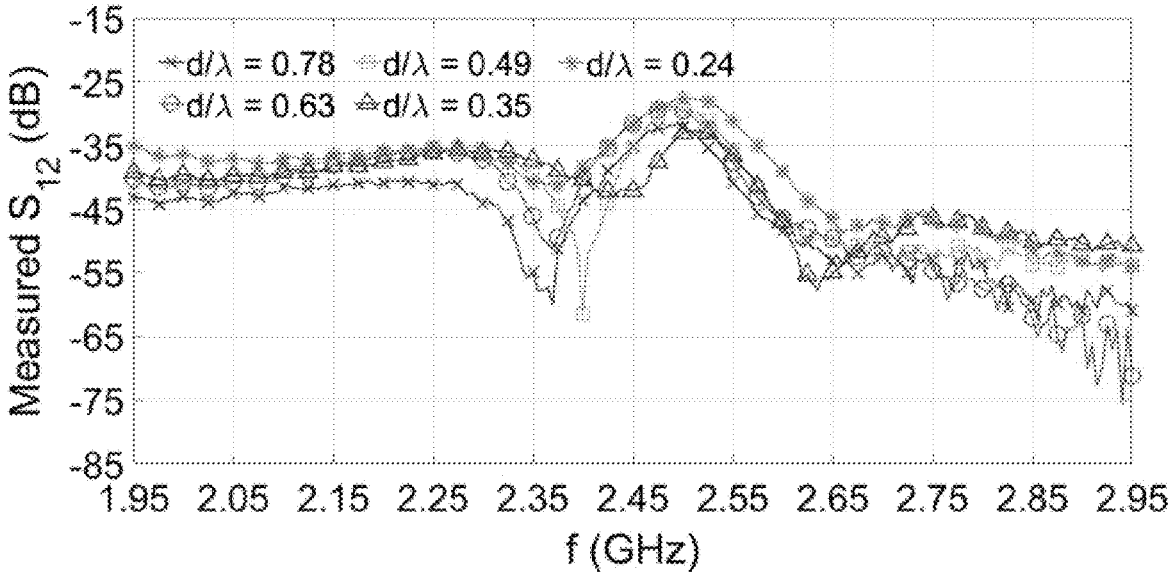
FIG. 12B is a plot of measured mutual coupling (in dB) between closest straight-fed and bend-fed patches for various inter-element spacings.

Maintaining a low mutual coupling between elements of a MIMO system is critical. Although coupling requirements vary based on the application, typically coupling values less than 15 dB are considered sufficient for MIMO operation. FIGS. 12A and 12B present the simulated and measured mutual coupling results, respectively, between the straight- and bent-fed patches for various inter-element spacings. The simulated (measured) maximum mutual coupling from all inter-element spacings in the 2.43-2.49 GHz band between all combinations of elements is presented in Table III. It is noted that $S_{12}$, $S_{13}$, and $S_{24}$ represent the mutual coupling between straight- and bent-fed elements, straight-fed elements, and bent-fed elements, respectively. FIGS. 12A and 12B indicate that the patches maintain a mutual coupling less than −27.6 dB throughout folding.

The observed coupling is due to the linearly polarized elements being orthogonally positioned with their centers co-aligned. If ideal patch elements are used in this orientation the coupling is zero. Coupling between patch elements in the actual antenna is mainly attributed to the increased cross polarization levels and slightly asymmetric radiation caused by the two slots cut into the patch. Although the slots are responsible for the increase in coupling, they are indispensable in attaining a reasonable bandwidth.

TABLE II

SHARED BANDWIDTH FOR VARIOUS INTER-ELEMENT SPACINGS

| Spacing | MIMO | Antenna of Patches Shared BW |
|---|---|---|
| d/λ = 0.78 | 2.37-2.49 | GHz (120 MHz) |
| d/λ = 0.63 | 2.37-2.49 | GHz (120 MHz) |
| d/λ = 0.49 | 2.37-2.49 | GHz (120 MHz) |
| d/λ = 0.35 | 2.42-2.49 | GHz (70 MHz) |
| d/λ = 0.24 | 2.43-2.49 | GHz (60 MHz) |

TABLE III

MAXIMUM MUTUAL COUPLING

| | Patches maximum mutual coupling (dB) simulated (measured) |
|---|---|
| $S_{12}$ | −28.6 (−27.6) |
| $S_{13}$ | −38 (−39.5) |
| $S_{24}$ | −31.9 (−33.3) |

The impact of inter-element spacing on the mean capacity of the antenna was investigated to demonstrate the operation of the capacity reconfigurable antenna. The mean capacity calculated using Equations (1) and (2) and peak gain variation as a function of inter-element spacing are shown in FIG. 8 ($N_r$=1000 and ρ=10 dB). The ideal mean capacity curve shown in FIG. 8 corresponds to the assumption that the MIMO antenna comprises completely isolated, perfectly matched elements, which are conjugate matched for optimal power transfer. Due to the fact that Equation (2) is independent of the radiating elements, dipole elements would have the same ideal mean capacity curve. The simulated mean capacity curve in FIG. 8 corresponds to results obtained via full wave simulation using ANSYS HFSS. The peak gain curve, denoted as simulated $G_p$, corresponds to the simulated peak gain when all the antenna ports are fed with the same amplitude and phase. This gain calculation takes into account reflections when feeding the elements. The SISO capacity curve is provided for comparison purposes and remains fixed at 1 bit/s/Hz when ρ=10 dB. Important points of FIG. 8 are summarized in Table IV.

TABLE IV

MEAN CAPACITY AND GAIN VARIATION

| | MIMO antenna of patches |
|---|---|
| Simulated $C_{max}$ ($C_{min}$)(bits/s/Hz) | 22.8 (19.7) |
| Measured $C_{max}$ ($C_{min}$) (bits/s/Hz) | 22.6 (19.3) |
| $G_{MaxPeak}$ ($G_{MinPeak}$) (dB) | 5 (0) |
| Simulated $\Delta C_{max-min}$ % | 15.7 |
| Measured $\Delta C_{max-min}$ % | 17 |
| $\Delta G_{Pmax-min}$ dB | 5 |

For each of the inter-element spacings, the seven $Z^T$ and $Z^R$ matrices used in Equation (2) were measured using an Agilent E5071C two port network analyzer. For simplicity, it was assumed that the same MIMO antenna was used at both the transmitter and the receiver so $Z^T=Z^R=Z$. The Z matrix was constructed by measuring the Z parameters of all the possible combinations of two port networks of the seven port MIMO antenna. When two ports of the MIMO antenna are measured, all the other ports are terminated in 50Ω loads. Due to the fact that the antennas are not perfectly matched to 50Ω, some reflections occur resulting in imperfect Z parameter measurements. Although there are methods to account for these small imperfections in matching, it was assumed that their effect on the computed capacity is negligible. This assumption was validated by the strong agreement between the simulated and measured mean capacity curves for the antenna.

Referring to FIG. 8, there is agreement between the ideal, simulated, and measured mean capacity curves for the antenna. As observed in FIG. 7, the maximum mean capacity for is achieved when d/λ=0.45. Further, mean capacity was maximized, on average, under ideal conditions followed by simulation and measurement. This is expected as mutual coupling degrades channel capacity in rich scattering environments. Due to imperfect fabrication, the mutual coupling of the measured antenna is slightly higher than simulation for some inter-element spacings as shown in FIGS. 12A and 12B.

FIG. 8 indicates that although the ideal mean capacity is on average greater than simulated values, for some inter-element spacings it falls slightly below simulated values by at most 0.1 bits/s/Hz. Although mutual coupling is known to significantly degrade channel capacity, it can improve channel capacity under certain conditions. This small improvement simulation over ideal conditions is attributed to this effect as well as small statistical variations in the channel matrix. Maximum peak gain, $G_p$, is achieved when d/λ=0.55 and 0.75. Therefore, the capacity and peak gain follow approximately the same trend. The peak gain curve in FIG. 8 indicates that the MIMO antenna is non-operational when $d/\lambda \leq 0.35$. Due to the Equation (2)'s independence with respect to the gain, it indicates that there is channel capacity although in reality, there is not.

Table IV further indicates that the MIMO antenna achieves great mean capacity variation, and this type of antenna actually achieves significantly greater mean capacity variation than when patch elements are used. This is due to the fact that the antenna may be non-operational for $d/\lambda \leq 0.35$ when patch elements are used. Also, the maximum peak gain when patch elements are used is 3.6 dB lower than when dipole elements are used, due to the patch elements operating on a thick and lossy substrate.

Figure 13:
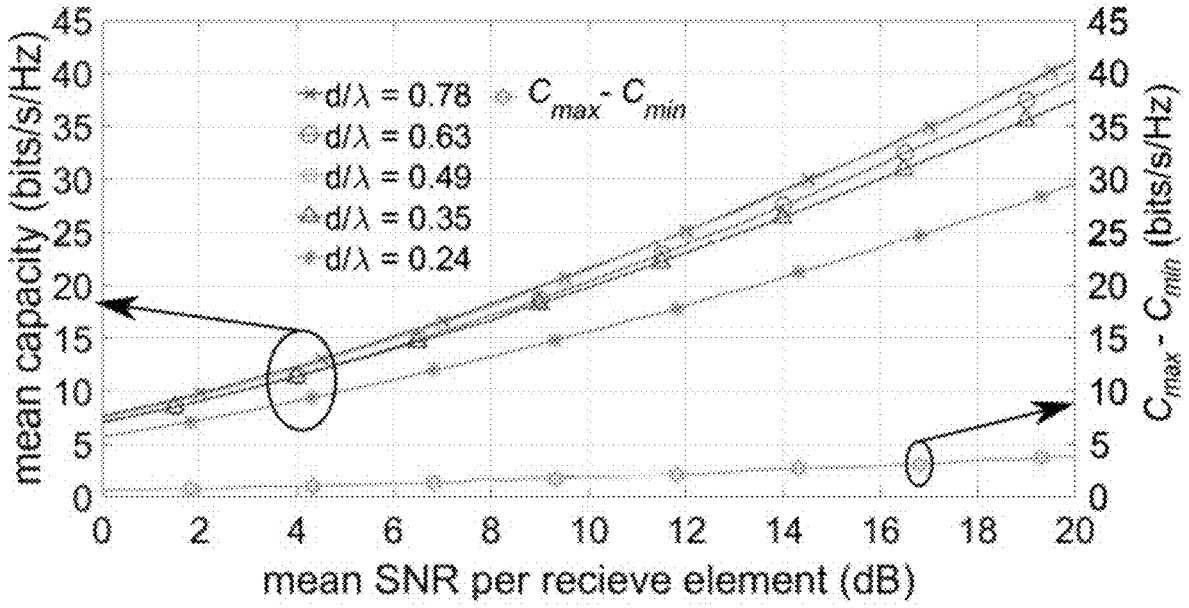
FIG. 13 is a plot of mean capacity (in bits/s/Hz; left vertical axis) and max capacity minus min capacity (in bits/s/Hz; right vertical axis) versus mean signal-to-noise ratio (SNR, in dB) per receive element, for various inter-element spacings of a MIMO antenna device.

The mean channel capacity as a function of the mean SNR per receive element for various inter-element spacings is shown in FIG. 13. This figure also shows the difference between the maximum and minimum mean capacity achieved through folding for each SNR. These are denoted as $C_{max}$ and $G_{min}$, respectively. The mean SNR per receive antenna element is given by Equation (3). When the elements are completely isolated from each other $\rho_c=\rho$.

$$\rho_c = \frac{P_o}{L_o P_n} \frac{\mathrm{Trace}\left(Z_T Z_T^{\dagger} \Psi^T\right)}{N|C_T|^2} \times \frac{\mathrm{Trace}\left(Z_R Z_R^{\dagger} \Psi^R\right)}{M|C_R|^2} \tag{3}$$

The antenna provides the least capacity in the fully folded state, and the $d/\lambda=0.49$ and 0.78 states providing the highest capacity regardless of SNR. From the $C_{max}-C_{min}$ curve in FIG. 13, when the SNR is low, folding produces a variation of less than 1 bit/s/Hz in mean capacity. In contrast, when the SNR is high, the folding results in a 4 bits/s/Hz variation in mean capacity. The benefits provided by inter-element spacing reconfigurability are dependent upon the received SNR (and also upon the radiating elements employed).

Example 3

Figure 14:
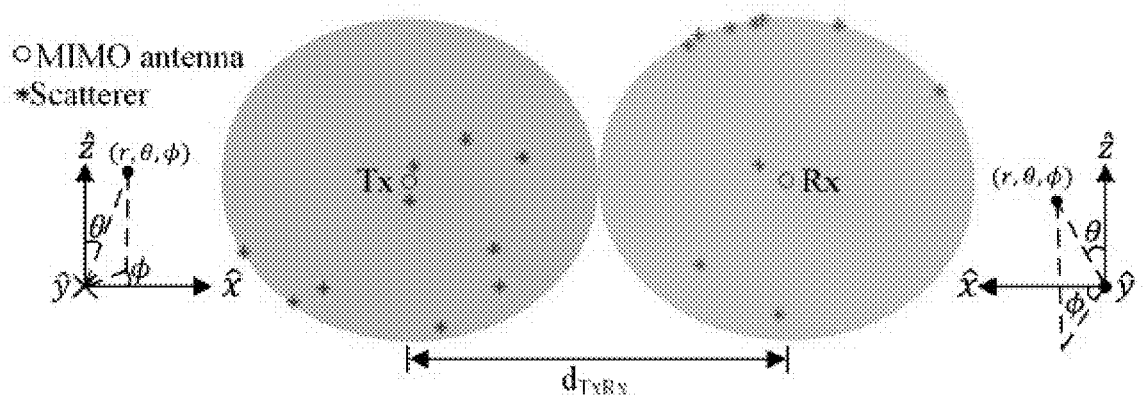
FIG. 14 is a schematic diagram of scatterers around transmit and receive antennas.

The mean channel capacity of a MIMO antenna in a reconfigurable remote sensing CubeSat swarm was characterized. In Equation (2), the channel matrix is only a function of the transmit and receive antenna impedance matrices and the spatial correlation under the assumption of uniform scattering. To model the CubeSat scattering environment and take into account antenna radiation patterns, the popular double-bouncing channel model was used to create the channel matrix. It was assumed that the transmitting and receiving antennas are identical. Two clusters of scatterers were created with $S_{Tx}$ and $S_{Rx}$ scatterers randomly positioned on spheres centered at the transmitting and receiving antennas, respectively. The radii of the spheres were assumed to be equal to half the distance between the transmit and receive antennas, as shown in FIG. 14. Referring to FIG. 14, there are twenty scatterers, ten randomly positioned about the transmit antenna and ten randomly positioned about the receive antenna. Scatterers were positioned with respect to the spherical coordinate systems presented in FIG. 14.

The channel matrix H, which is a function of the scatterer positions and properties, is an $n_r \times n_t$ matrix computed using Equation (4), where $H_1$ is a $S_{Tx} \times N$ matrix with elements $H_{1ij}$, where $H_{1ij}$ is a 2×1 vector containing the $E_\theta$ and $E_\phi$ components of the field radiated by the $j^{th}$ transmit element at the $i^{th}$ scatterer surrounding the transmit antenna. $H_3$ is an $M \times S_{Rx}$ matrix with elements $H_{1ij}$, where $H_{1ij}$ is a 1×2 vector containing the $E_\theta$ and $E_\phi$ components of the field scattered by the $j^{th}$ scatterer surrounding the receive antenna at the $i^{th}$ receive antenna. $H_2$ is a $S_{Rx} \times S_{Tx}$ matrix with elements $H_{1ij}$, where $H_{1ij}$ is a 2×2 scattering matrix with random complex Gaussian numbers as entries. The scattering matrix S is utilized as shown in Equation (5) to produce the reflected fields $E_{\theta r}$ and $E_{\phi r}$ from the incident fields $E_{\theta i}$ and $E_{\phi i}$. Normally there is cross coupling between $\hat{\theta}$ and $\hat{\phi}$ components. However, under ideal conditions, there is no cross coupling by having S be a diagonal matrix.

$$H = H_3 H_2 H_1 \tag{4}$$

$$\begin{pmatrix} E_{\theta r} \\ E_{\phi r} \end{pmatrix} = S \begin{pmatrix} E_{\theta i} \\ E_{\phi i} \end{pmatrix} = \begin{pmatrix} \alpha_{11} & \alpha_{12} \\ \alpha_{21} & \alpha_{22} \end{pmatrix} \begin{pmatrix} E_{\theta i} \\ E_{\phi i} \end{pmatrix} \tag{5}$$

Figure 15:
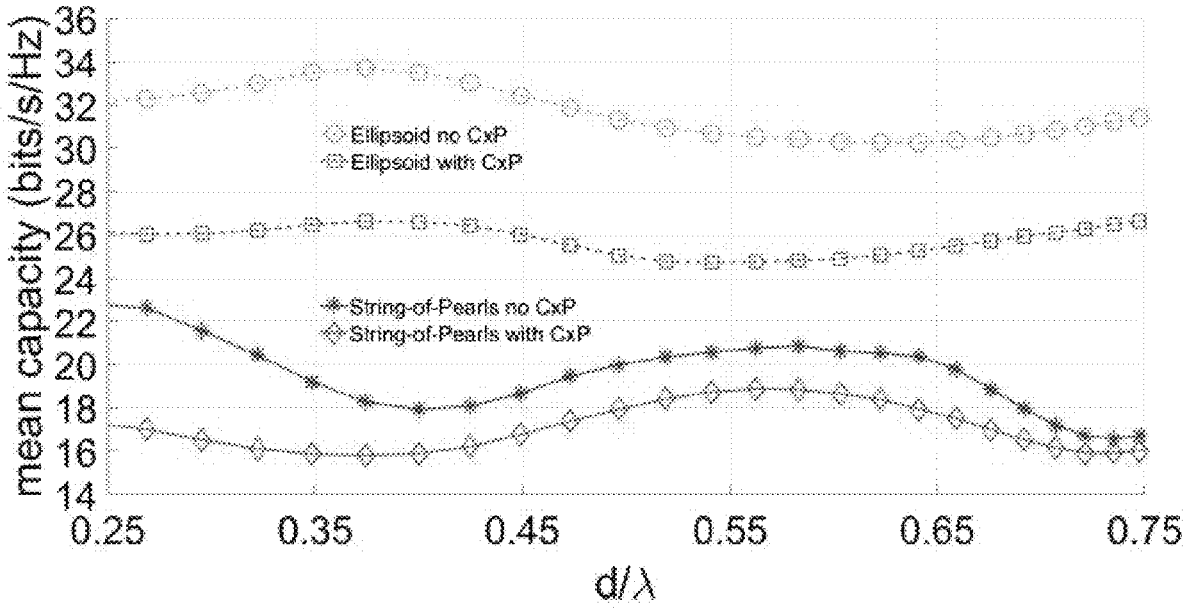
FIG. 15 is a plot of mean capacity (in bits/s/Hz; left vertical axis) versus the result of inter-element spacing (d, in FIG. 3) divided by wavelength for a MIMO antenna device mounted on CubeSats.

Let the length of the MIMO antenna be along the y-axis and the width be along the z-axis with respect to both the transmitter and receiver coordinate systems such that the two antennas are facing each other. Let the transmit and receive antennas be a distance $d_{TxRx}$ apart. Using CubeSats as scatterers, the situation depicted in FIG. 14 corresponds to the propagation environment of a twenty CubeSat swarm in an ellipsoid configuration. Both scatterer spheres are contained within the ellipsoid. A string-of-pearls configuration is modeled by having two CubeSats, which act as scatterers, between the transmitting and receiving CubeSats. The mean capacity as a function of the inter-element spacing of the MIMO antenna under the ellipsoid and string-of-pearls configuration is shown in FIG. 15.

The simulated and measured radiated fields were in agreement. Due to the large amount of measured data required to produce FIG. 15, simulated data was used for the elements of $H_1$ and $H_3$ representative of radiated fields.

The string-of-pearls scattering environment was modeled by having both transmit and receive scatterers at $(\theta,\phi)=(40°, 0°)$ with respect to their coordinate systems. The mean capacity with and without cross polarization coupling, denoted as C×P, are provided for comparison between non-ideal and ideal scattering environments, respectively. The capacity was computed using Equation (1), the mean capacity was averaged over 1000 iterations, and p=10 dB as before. In both the ellipsoid and string-of-pearls formations, the scatterer properties were varied for each iteration to model different orientations of the scattering CubeSats with respect to the transmitting and receiving CubeSats. In the ellipsoid configuration, scatterer positions were also randomly generated for each iteration to model the physical relative movement of the CubeSats.

The mean capacity with and without cross polarization coupling generally follows the same trend regardless of the radiating element used. Due to the fact that cross polarization coupling results in depolarization, the mean capacity without cross polarization coupling is on average greater than the mean capacity with cross polarization coupling. The mean capacity in the ellipsoid formation is on average greater than the mean capacity in the string-of-pearls formation due to the fact that the ellipsoid formation presents a richer scattering environment than the string-of-pearls configuration.

Optimal mean capacity was achieved at $d/\lambda=0.37$ and 0.58 in the ellipsoid configuration and string-of-pearls configurations, respectively, regardless of cross polarization coupling. Table III indicates that in order to achieve optimal capacity in both the ellipsoid and string-of-pearls formations, the inter-element spacing must be varied. If it is not, then 3.3 bits/s/Hz are lost when designing for optimal capacity in the ellipsoid formation or 2.6 bits/s/Hz are lost when designing for optimal capacity in the string-of-pearls formation. This indicates that inter-element spacing reconfigurability is critical in maintaining high data rate communications in dynamic propagation environments when directional elements are used.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A multiple-input-multiple-output (MIMO) antenna device, comprising:

a substrate; and a plurality of patch portions separated from each other by folds in the substrate, each patch portion comprising an antenna element disposed on the substrate, and the plurality of patch portions comprising:

at least one straight-fed patch portion, the antenna element of each straight-fed patch portion being a straight-fed antenna element; and at least one bent-fed patch portion, the antenna element of each bent-fed patch portion being a bent-fed antenna element, the at least one straight-fed patch portion and the at least one bent-fed patch portion being disposed in an alternating fashion such that no straight-fed patch portion is directly adjacent to another straight-fed patch portion and no bent-fed patch portion is directly adjacent to another bent-fed patch portion, the MIMO antenna device further comprising a framework to which the substrate is attached, the framework being an actuating framework comprising at least one motor, such that the framework is configured to expand or contract the substrate in an accordion-style when actuated, and the framework being a scissor-lift actuator.

2. The MIMO antenna device according to claim 1, each straight-fed antenna element comprising a trace that extends inward from an edge of the substrate and connects to a proximal side of an E-shaped patch, where a distal side of the E-shaped patch opposite from the proximal side thereof faces towards an opposite edge of the substrate from the edge from which the trace extends, and each bent-fed antenna element comprising a trace that extends inward from an edge of the substrate, turns, and connects to a proximal side of an E-shaped patch, where a distal side of the E-shaped patch opposite from the proximal side thereof faces towards an adjacent edge of the substrate from the edge from which the trace extends.

3. The MIMO antenna device according to claim 2, the turn of each bent-fed antenna element being a 90° turn.

4. The MIMO antenna device according to claim 1, each patch portion of the plurality of patch portions comprising an E-shaped patch comprising a patch element with two nooks.

5. The MIMO antenna device according to claim 1, the device being configured to vary channel capacity and gain of the respective patch portions by varying inter-element spacing of the MIMO antenna device, inter-element spacing being a shortest distance between a center of a patch of a first patch portion of the plurality of patch portions and a center of a patch of a second patch portion of the plurality of patch portions that is directly adjacent to the first patch portion.

6. The MIMO antenna device according to claim 1, each patch portion comprising circuit elements disposed on the substrate, the antenna element of each patch portion being disposed on the respective circuit elements.

7. The MIMO antenna device according to claim 6, the circuit elements of each straight-fed patch portion being shaped differently from those of each bent-fed patch portion.

8. The MIMO antenna device according to claim 1, the substrate having a thickness of less than 2.0 millimeters (mm).

9. The MIMO antenna device according to claim 1, the substrate comprising FR4.

10. A multiple-input-multiple-output (MIMO) antenna device, comprising:

a plurality of substrates respectively connected to each other by a plurality of hinges; and a plurality of patch portions respectively disposed on the plurality of substrates and separated from each other by the hinges, each patch portion comprising an antenna element disposed on the respective substrate, and the plurality of patch portions comprising:

a plurality of straight-fed patch portions, the antenna element of each straight-fed patch portion being a straight-fed antenna element; and a plurality of bent-fed patch portions, the antenna element of each bent-fed patch portion being a bent-fed antenna element, the plurality of straight-fed patch portions and the plurality of bent-fed patch portions being disposed in an alternating fashion such that no straight-fed patch portion is directly adjacent to another straight-fed patch portion and no bent-fed patch portion is directly adjacent to another bent-fed patch portion, the MIMO antenna further comprising a framework to which the plurality of substrates are attached, the framework being an actuating framework comprising at least one motor, such that the framework is configured to expand or contract the plurality of substrates in an accordion-style when actuated, and the framework being a scissor-lift actuator.

11. The MIMO antenna device according to claim 10, each straight-fed antenna element comprising a trace that extends inward from an edge of the substrate and connects to a proximal side of an E-shaped patch, where a distal side of the E-shaped patch opposite from the proximal side thereof faces towards an opposite edge of the substrate from the edge from which the trace extends, and each bent-fed antenna element comprising a trace that extends inward from an edge of the substrate, turns, and connects to a proximal side of an E-shaped patch, where a distal side of the E-shaped patch opposite from the proximal side thereof faces towards an adjacent edge of the substrate from the edge from which the trace extends.

12. The MIMO antenna device according to claim 11, the turn of each bent-fed antenna element being a 90° turn.

13. The MIMO antenna device according to claim 10, the device being configured to vary channel capacity and gain of the respective patch portions by varying inter-element spacing of the MIMO antenna device, inter-element spacing being a shortest distance between a center of a patch of a first patch portion of the plurality of patch portions and a center of a patch of a second patch portion of the plurality of patch portions that is directly adjacent to the first patch portion.

14. The MIMO antenna device according to claim 10, each patch portion comprising circuit elements disposed on the respective substrate, the antenna element of each patch portion being disposed on the respective circuit elements.

15. The MIMO antenna device according to claim 10, the plurality of substrates being connected to each other in a single-file row.

16. A multiple-input-multiple-output (MIMO) antenna device, comprising:

a plurality of substrates respectively connected to each other in a single-file row by a plurality of hinges;

a framework to which the plurality of substrates are attached; and a plurality of patch portions respectively disposed on the plurality of substrates and separated from each other by the hinges, each patch portion comprising an antenna element disposed on the respective substrate, and the plurality of patch portions comprising:

a plurality of straight-fed patch portions, the antenna element of each straight-fed patch portion being a straight-fed antenna element; and a plurality of bent-fed patch portions, the antenna element of each bent-fed patch portion being a bent-fed antenna element, the plurality of straight-fed patch portions and the plurality of bent-fed patch portions being disposed in an alternating fashion such that no straight-fed patch portion is directly adjacent to another straight-fed patch portion and no bent-fed patch portion is directly adjacent to another bent-fed patch portion, each straight-fed antenna element comprising a trace that extends inward from an edge of the substrate and connects to a proximal side of an E-shaped patch, where a distal side of the E-shaped patch opposite from the proximal side thereof faces towards an opposite edge of the substrate from the edge from which the trace extends, each bent-fed antenna element comprising a trace that extends inward from an edge of the substrate, turns, and connects to a proximal side of an E-shaped patch, where a distal side of the E-shaped patch opposite from the proximal side thereof faces towards an adjacent edge of the substrate from the edge from which the trace extends, the turn of each bent-fed antenna element being a 90° turn, the framework being a scissor-lift actuator comprising at least one motor, such that the framework is configured to expand or contract the plurality of substrates in an accordion-style when actuated, the device being configured to vary channel capacity and gain of the respective patch portions by varying inter-element spacing of the MIMO antenna device, inter-element spacing being a shortest distance between a center of a patch of a first patch portion of the plurality of patch portions and a center of a patch of a second patch portion of the plurality of patch portions that is directly adjacent to the first patch portion, each patch portion comprising circuit elements disposed on the substrate on which it is disposed, the antenna element of each patch portion being disposed on the respective circuit elements, and each substrate of the plurality of substrates having a thickness of less than 2.0 mm.

* * * * *